US006253719B1

(12) United States Patent
Methley

(10) Patent No.: US 6,253,719 B1
(45) Date of Patent: Jul. 3, 2001

(54) VARIABLE PHASE MECHANISM

(75) Inventor: Ian Methley, Witney (GB)

(73) Assignee: Mechadyne PLC, Kirtlington (GB)

( * ) Notice: Subject to any disclaimer, the term of this patent is extended or adjusted under 35 U.S.C. 154(b) by 0 days.

(21) Appl. No.: 09/507,094

(22) Filed: Feb. 17, 2000

(30) Foreign Application Priority Data

Feb. 18, 1999 (GB) ..... 9903623

(51) Int. Cl.[7] ..... F01L 13/00
(52) U.S. Cl. ..... 123/90.17
(58) Field of Search ..... 123/90.17, 90.31, 123/90.15; 464/2; 74/568 R

(56) References Cited

U.S. PATENT DOCUMENTS 5,219,313 * 6/1993 Danieli ..... 464/2
5,542,383 * 8/1996 Clarke et al. ..... 123/90.17
5,592,909 * 1/1997 Tsuruta ..... 123/90.17
5,657,671 * 8/1997 Morii ..... 123/90.17
5,671,706 * 9/1997 Frost et al. ..... 123/90.17
5,738,056 * 4/1998 Mikame et al. ..... 123/90.17
5,794,578 * 8/1998 Strauss et al. ..... 123/90.17
5,797,361 * 8/1998 Mikame et al. ..... 123/90.17
5,875,751 * 3/1999 Strauss et al. ..... 123/90.17
6,182,623 * 2/2001 Sugie et al. ..... 123/90.17

* cited by examiner

*Primary Examiner*—Teresa Walberg
*Assistant Examiner*—Vinod D Patel
(74) *Attorney, Agent, or Firm*—Smith-Hill and Bedell

(57) ABSTRACT

A variable phase mechanism comprises a hollow shaft 16, first 10 and second 14 members rotatable about the hollow shaft 16 and two yokes 18, 20 surrounding the hollow shaft 16, one yoke 18 coupling the hollow shaft 16 for rotation with first member 10 and the other yoke 20 coupling the second member 14 for rotation with the first member 10. An actuating rod 32 is slidably received in the hollow shaft 16, and has cam surfaces 36, 38 that on the first yoke 18 by way of a plungers 40 passing through a generally radial bore in the hollow shaft 16 to cause the first yoke 18 to move radially in response to axial movement of the actuating rod and thereby vary the angular position of the first member 10 relative to the hollow shaft 16. Rotation of the hollow shaft 16 relative to the first member 10 causes the outer surface of the hollow shaft 16 to interact with the inner surface of the second yoke 20 to cause the angular position of the second member 14 to be varied in relation to the first member 10.

21 Claims, 4 Drawing Sheets

VARIABLE PHASE MECHANISM

FIELD OF THE INVENTION

The present invention relate to a variable phase mechanism for use in a valve train of an internal combustion engine to permit the crank angles at which the valves open and close to be varied.

BACKGROUND OF THE INVENTION

As is well known, valve timing has a significant effect on engine performance and the optimum setting varies with engine operating conditions. To optimize performance under different operating conditions, it is necessary to be able to vary the valve timing.

Various variable valve timing mechanisms have been proposed in the past that achieve a variable phase. These mechanisms have suffered from various problems. Some, though feasible, have been costly to implement and some have developed excessive friction or not proved to be reliable. Furthermore, many could not be fitted as a modification to existing engines and required much of the valve train and cylinder head to be redesigned.

The most relevant prior art is believed to be the Applicants' own earlier proposal in EP-A-0 733 154. This discloses a valve operating mechanism comprising a hollow shaft, a sleeve journalled on the hollow shaft and fast in rotation with a cam, a coupling yoke connected by a first pivot pin to the hollow shaft and by a second pivot pin to the sleeve and means for moving the yoke radially to effect a phase change between the hollow shaft and the sleeve, wherein the means for moving the yoke radially comprise an actuating rod slidably received in the hollow shaft, a cam surface on the actuating rod and a plunger passing through a generally radial bore in the hollow sleeve to cause the yoke to move radially in response to axial movement of the actuating rod.

OBJECTS OF THE INVENTION

The present invention seeks to provide an improvement of the latter proposal which, in its different embodiments, can either allow a greater degree of angular movement to be achieved or can enable the same phase change mechanism to be used to vary the phase of both the intake and the exhaust camshafts of an engine.

SUMMARY OF THE INVENTION

According to a first aspect of the present invention, there is provided a variable phase mechanism comprising a hollow shaft, first and second members rotatable about the hollow shaft, two yokes surrounding the hollow shaft, one yoke coupling the hollow shaft for rotation with first member and the other coupling the second member for rotation with the first member, an actuating rod slidably received in the hollow shaft, a cam surface on the actuating rod acting on the first yoke by way of a plunger passing through a generally radial bore in the hollow shaft to cause the first yoke to move radially in response to axial movement of the actuating rod so as to vary the angular position of the first member relative to the hollow shaft, rotation of the hollow shaft relative to the first member causing the outer surface of the hollow shaft to interact with the inner surface of the second yoke to cause the angular position of the second member to be varied in relation to the first member.

In the first aspect of the invention, a single variable phase mechanism can be used to drive two shafts, for example the intake and exhaust camshafts of a dual overhead camshaft engine. The first member may in this case be the drive sprocket connecting the engine crankshaft to the first camshaft, the latter being fast in rotation with the hollow shaft. The second member rotatable on the hollow shaft may be a drive sprocket serving to drive the other camshaft. The effect of axially displacing the actuating rod would be to advance the timing of one shaft while retarding the timing of the other.

The invention is not however restricted to its use in driving two camshafts using a single variable phase mechanism. It can also be used to drive a single camshaft while increasing the range of angular adjustment by the use of two yokes in tandem.

Hence, in accordance with a second aspect of the invention, there is provided a variable phase mechanism comprising a hollow shaft, first and second members rotatable about the hollow shaft, two yokes surrounding the hollow shaft, one yoke coupling the hollow shaft for rotation with the first member and the other coupling the first member for rotation with the second member, an actuating rod slidably received in the hollow shaft, a cam surface on the actuating rod acting on the first yoke by way of a plunger passing through a generally radial bore in the hollow shaft to cause the first yoke to move radially in response to axial movement of the actuating rod so as to vary the angular position of the first member relative to the hollow shaft, the resultant rotation of the first member about the hollow shaft causing the outer surface of the hollow shaft to interact with the inner surface of the second yoke to cause the angular position of the second member to be further varied in relation to the hollow shaft.

In this embodiment, the first member is not a drive member but simply a freely rotating disc arranged between the two yokes. Torque is transmitted from the second member to the first member and from the first member to the hollow shaft. The combined effect of the angular movements of the two yokes is to increase the angular displacement of the second member relative to the hollow shaft for a given movement of the actuating rod.

In a further aspect of the invention using two yokes in tandem to increase the angular adjustment range, it is possible to dispense with the first member rotatable on the hollow shaft and to connect the two yokes directly to one another.

Hence, in accordance with a third aspect of the invention, there is provided a variable phase mechanism comprising a hollow shaft, a member rotatable about the hollow shaft, two yokes surrounding the hollow shaft, the first yoke coupling the hollow shaft for rotation with the second yoke and the second yoke coupling the first yoke for rotation with the rotatable member, an actuating rod slidably received in the hollow shaft, a cam surface on the actuating rod acting on the first yoke by way of a plunger passing through a generally radial bore in the hollow shaft to cause the first yoke to move radially in response to axial movement of the actuating rod so as to vary the angular position of the second yoke relative to the hollow shaft, the resultant rotation of the second yoke about the hollow shaft causing the outer surface of the hollow shaft to interact with the inner surface of the second yoke to cause the angular position of the rotatable member to be further varied in relation to the hollow shaft.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
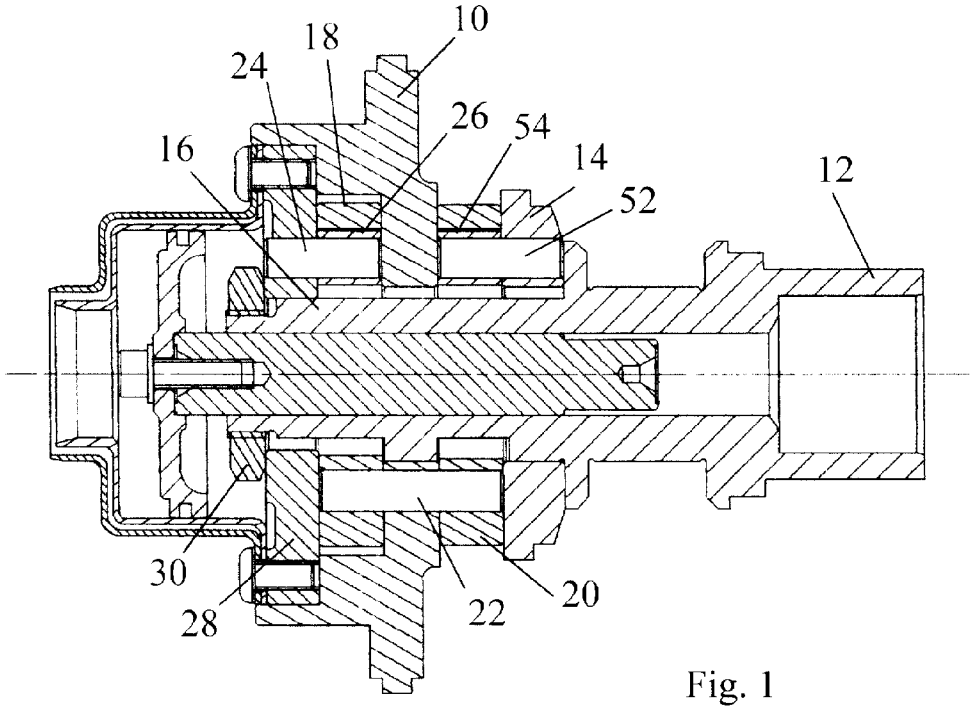
FIG. 1 is an axial section through a variable phase mechanism of a first embodiment of the invention.

FIGS. 1 to 7 show a variable phase mechanism that has a drive pulley 10 connected to be driven by the engine crankshaft, a camshaft 12 that is rotatable with variable phase in relation to the drive pulley 10 and a driven pulley 14 that can itself be used to drive a second camshaft and that is also rotatable with variable phase in relation to the drive pulley 10. The end of the camshaft 12 is formed as a hollow shaft 16 on which the two pulleys 10 and 14 are rotatably mounted. The coupling between the hollow shaft 16 and the two pulleys is effected by two yokes 18 and 20 that are better shown in FIGS. 4 and 5 and FIGS. 6 and 7, respectively.

The yoke 18 is a ring having a contoured inner surface that surrounds the hollow shaft 16 with clearance. To one side of the hollow shaft 16, the yoke 18 is connected by a pivot pin 22 to the drive pulley 10. To the other side of the hollow shaft 16, the yoke 18 is connected by means of a pin 24 and a slide block 26 to an annular disk 28 that is fast in rotation with the hollow shaft 16 and secured to the hollow shaft 16 by means of a nut 30. As the yoke 18 rocks from about the pin 22 (compare FIGS. 4 and 5), the pin 24 moves from side to side and rotates the disk 28 and the hollow shaft 16 relative to the drive pulley 10, the slide block 26 permitting the necessary simultaneous radial movement of the pin 24. In this way, the angular position of the hollow shaft 16 is varied in relation to the drive pulley 10, that is to say their relative phase is changed when they rotate at the same speed.

Figure 2:
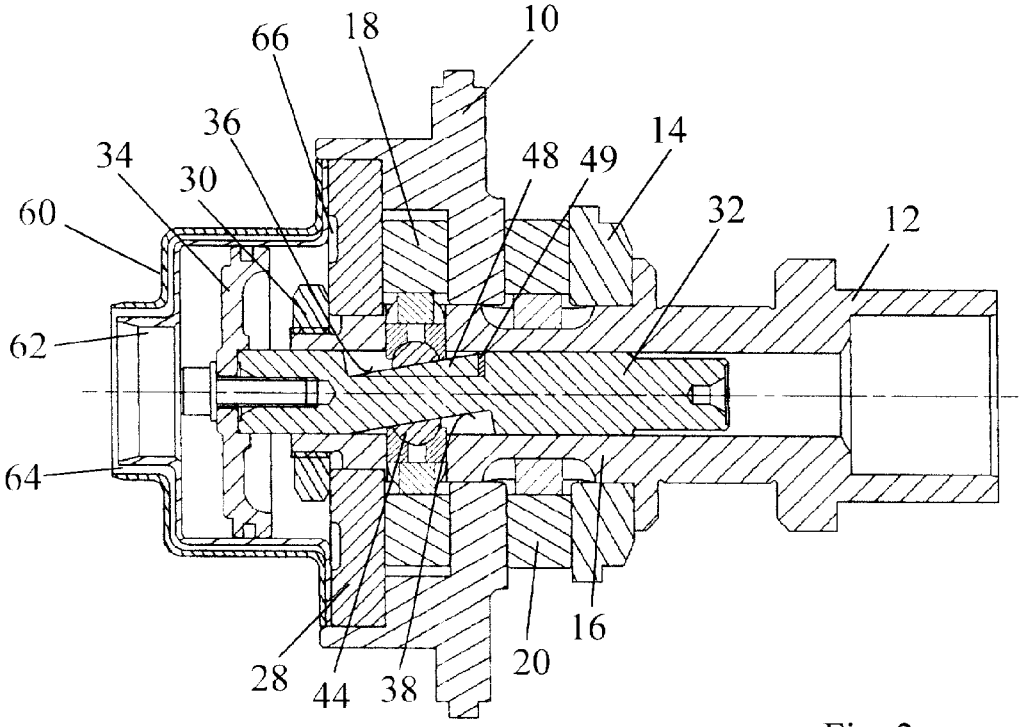
FIG. 2 is an axial section through the variable phase mechanism of FIG. 1 taken through the plane normal to the section plane in FIG. 1.
Figure 3:
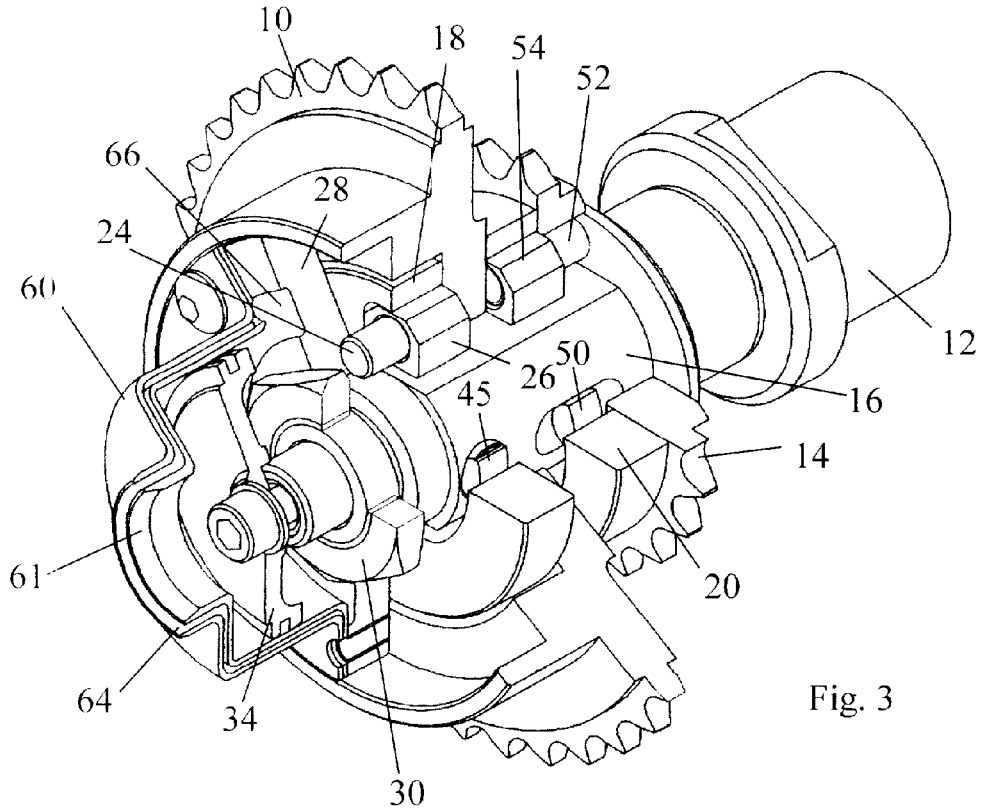
FIG. 3 is a partly cut-away perspective view of the variable phase mechanism of FIGS. 1 and 2, FIGS. 4 and 5 are sections in a plane normal to the rotational axis passing through the first yoke and the plungers.
Figure 4:
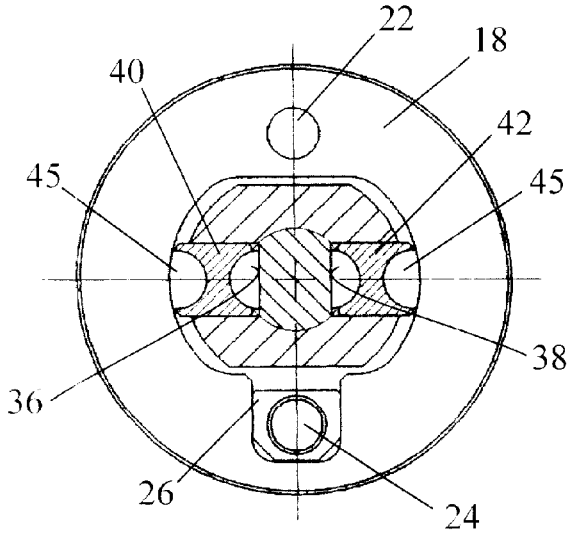
Figure 5:
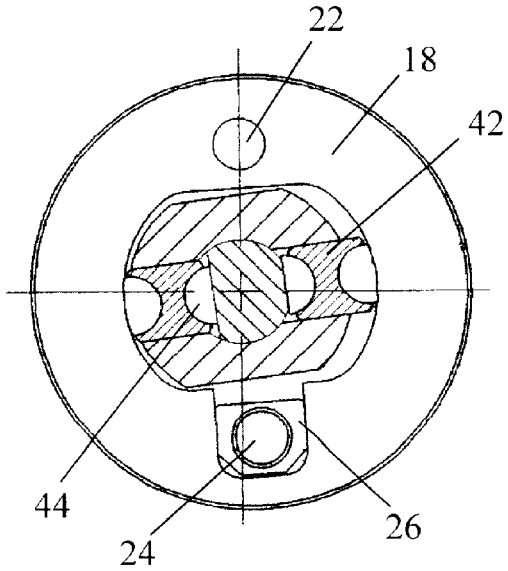

The mechanism for moving of the yoke 18 from side to side is best illustrated by FIGS. 2, 4 and 5. An actuating rod 32 movable by a piston 34 is axially slideable within the hollow shaft 16. The actuating rod 32 has two cam surfaces in the form of oppositely sloping ramps 36, 38 that act on the inner surface of the yoke 18 by way of two plungers 40, 42. Each of the plungers 40, 42 is formed at one end with a part spherical shoe 44 and with a part cylindrical shoe 45 at its other end so that the plungers at all times make surface contact with the actuating rod 32 and the contoured inner surface of the yoke 18. As the yoke 18 pivots about the pin 22, the hollow shaft 16 and the plungers 40, 42 also rotate under the action of the pin 24.

In order to avoid backlash, it is important to ensure that the shoes 44 on the ends of the plungers 40, 42 remain in contact with the cam surfaces 36, 38 and with the inner surface of the yoke 18 at all times. This is achieved in that one of the cam surfaces 38 is defined by a slideable wedge 48 that is biased by a resilient member 49 in a direction to widen the distance between the two cam surfaces 36, 38.

Figure 6:
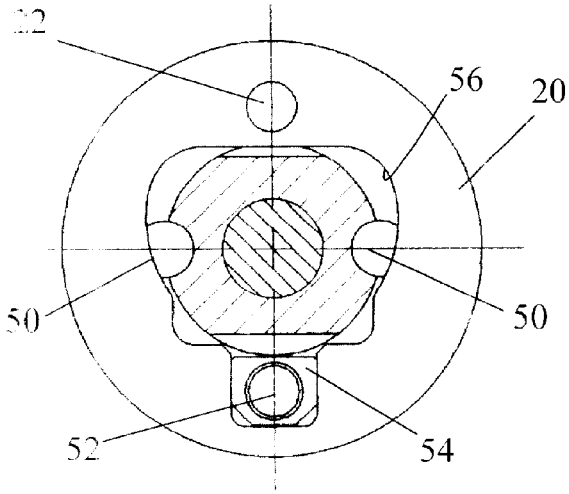
FIGS. 6 and 7 are sections in a plane normal to the rotational axis passing through the second yoke.
Figure 7:
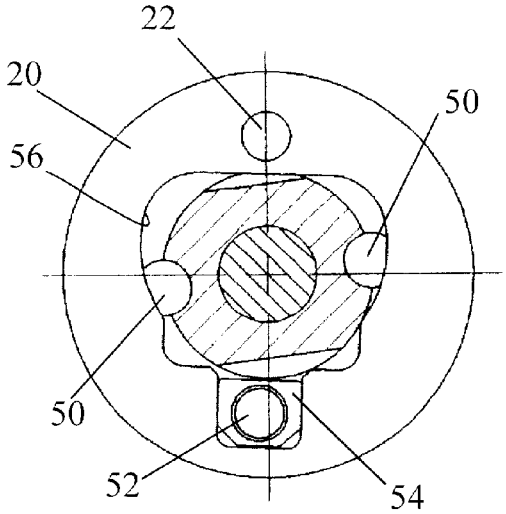

Referring now to FIGS. 6 and 7, it will be seen that the hollow shaft 16 has two further part-cylindrical shoes 50 that are received directly in part-cylindrical recesses in the surface of the hollow shaft 16. These shoes 50 make contact with the contoured inner surface of the second yoke 20 which is pivoted on one side by means of the pin 22 to the drive pulley 10 and is coupled on the other side by means of a pin 52 and a slide block 54 to the second pulley 14. Because of the contouring of the inner surface 56 of the yoke 20, it moves from side to side as the hollow shaft 16 rotates and this in turn causes the pulley 14 to rotate in the opposite sense relative to the drive pulley 10. In this case, backlash can be avoided by the resilience of the yoke 20 or by resiliently biasing the shoes 50 towards the yoke surface 56.

The piston 34 connected to the actuating rod 32 is reciprocable in a double skinned cylinder 60. Oil can be pumped into the working chamber to the left of the piston 34, as viewed, through a central opening 62 to chamber on the opposite side of the piston 34 through the annular gap 64 between the two skins of the cylinder 60 and through an annular recess 66 machined into the front face of the disk 28.

The embodiment of FIGS. 1 to 7 has two phase changers constituted by the two yokes 18 and 20 that are connected effective in parallel with one another to transmit torque from the drive pulley 10 to two separate elements, namely the camshaft 12 and the pulley 14. The embodiments of FIGS. 8 and 9 differ in that they have two phase changers connected in series with one another to double the maximum angular displacement of a camshaft 112 relative to its drive pulley 110.

Figure 8:
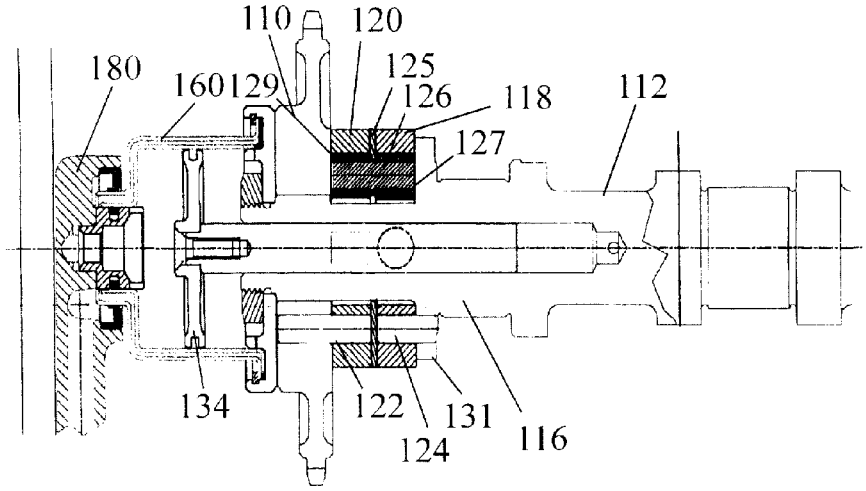
FIG. 8 is an axial section similar to that of FIG. 1 showing a second embodiment of the invention.

In FIG. 8, the drive pulley 110 is freely rotatable on the hollow shaft 116. The first yoke 118 is pivoted on the hollow shaft 116 by means of a fixed pin 124, the second yoke 120 is pivoted on the drive pulley 110 by a second fixed pin 122. The two yokes 118 and 120 are connected to one another on the opposite side of the hollow shaft 116 from the pins 122 and 124 by a pin 126 located in sliders 127,129 in the two yokes 118,120. The pin 126 passes through a thin separator 125 that is rotatable about the hollow shaft 116. The other components including the actuating rod, the plungers and the hydraulic system for displacing the actuating rod are all as previously described.

FIG. 8 also shows an engine front cover 180 that is stationarily mounted in relation to the engine block that fits over the end of the double-skinned cylinder 160 through appropriate rotary seals to supply oil to the working chambers of the hydraulic piston 134.

In this embodiment, movement of the actuating rod causes the yoke 118 to swing from side to side by the action of its cam surfaces and the plungers. This causes a rotation of the separator 125 and the pin 126 about the pin 124 in the hollow shaft 116. The side to side movement of the pin 126 causes the second yoke 120 to rotate about the hollow shaft 116 which interacts with the inner surface of the second yoke 120 to cause a further rotation of the drive pulley 110 relative to the hollow shaft 116.

The purpose of the separator 125 in the embodiment of FIG. 8 is to maintain the radius of the pin 126 constant in relation to the axis of rotation of the hollow shaft 116. This is necessary because the pin 126 is held in slide blocks 127, 129 in both yokes and in the absence of the separator 125 it would be able to move indiscriminately in a radial direction.

Figure 9:
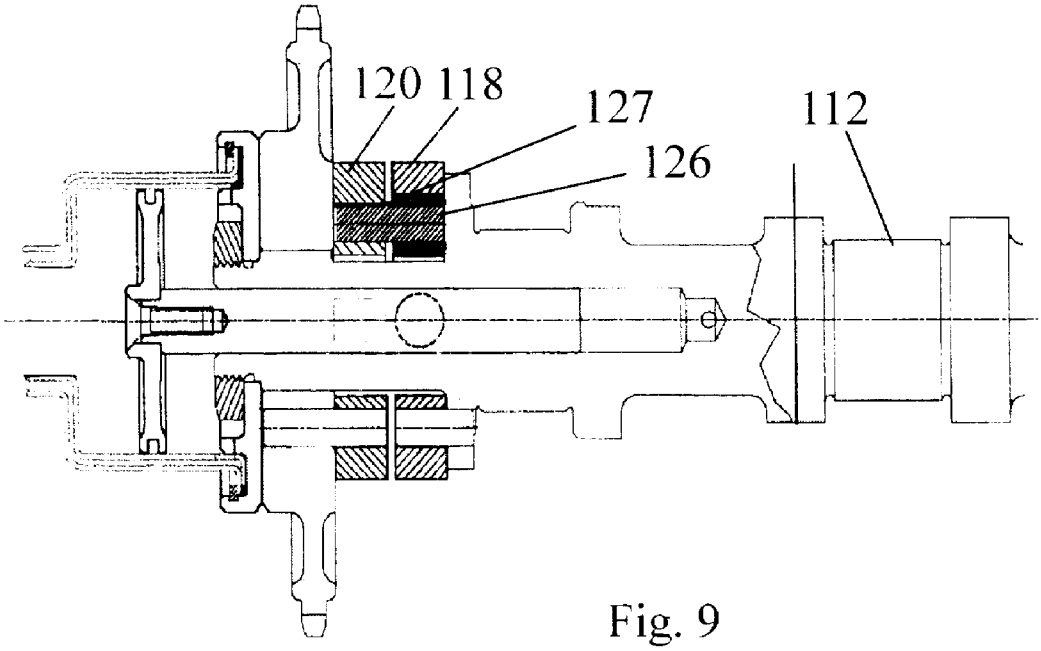
FIG. 9 is an axial section similar to that of FIG. 8 showing a third embodiment of the invention.

The alternative to the provision of a separator 125 is shown in FIG. 9. This embodiment of the invention is essentially the same as that of FIG. 8 except that the pin 126 is fixed in relation to the yoke 118 and is only held in a slide block 127 in the yoke 120. The slide block 129 has been omitted which also allows the omission of the separator 125.

What is claimed is:

1. A variable phase mechanism comprising a shaft, first and second members rotatable about the shaft and a yoke coupling the first member for rotation with the second member wherein rotation of the first member relative to the shaft causes the outer surface of the shaft to interact with the inner surface of the yoke so as to cause the angular position of the second member to be varied in relation to the first member.

2. A variable phase mechanism as claimed in claim 1, wherein the shaft is fast in rotation with a first camshaft of a dual camshaft engine, the first member is a drive sprocket to be driven in use by the engine crankshaft and serving to drive the first camshaft by way of means for varying the phase of the first member in relation to the first camshaft, and the second member is a drive sprocket for connecting the first camshaft of the engine to a second camshaft the engine.

3. A variable phase mechanism as claimed in claim 1, wherein the actuating rod is connected to a hydraulic piston.

4. A variable phase mechanism as claimed in claim 3, wherein the piston is a double acting piston reciprocable within a cylinder having a double skinned wall, pressure medium being supplied to the working chamber on one side of the piston through the gap in the double skinned wall.

5. A variable phase mechanism as claimed in claim 3, wherein the actuating rod has opposed ramp surfaces of which one is defined by a wedge movable relative to the body of the actuating rod and resiliently biased in a direction to increase the distance between the two ramp surfaces.

6. A variable phase mechanism comprising a hollow shaft, first and second members rotatable about the hollow shaft, two yokes surrounding the hollow shaft, one yoke coupling the hollow shaft for rotation with first member and the other coupling the second member for rotation with the first member, an actuating rod slidably received in the hollow shaft, a cam surface on the actuating rod acting on the first yoke by way of a plunger passing through a generally radial bore in the hollow shaft to cause the first yoke to move radially in response to axial movement of the actuating rod so as to vary the angular position of the first member relative to the hollow shaft, rotation of the hollow shaft relative to the first member causing the outer surface of the hollow shaft to interact with the inner surface of the second yoke to cause the angular position of the second member to be varied in relation to the first member.

7. A variable phase mechanism as claimed in claim 6, wherein the hollow shaft is fast in rotation with a first camshaft of a dual camshaft engine, the first member is a drive sprocket connecting the engine crankshaft to the first camshaft, and the second member rotatable on the hollow shaft is a drive sprocket serving to transmit drive torque to the second camshaft.

8. A variable phase mechanism as claimed in claim 7, wherein part-cylindrical shoes are provided on the ends of the plungers acting on the inner surface of the first yoke.

9. A variable phase mechanism as claimed in claim 7, wherein part-cylindrical shoes are fitted into the surface of the shaft to act on the inner surface of the second yoke.

10. A variable phase mechanism as claimed in claim 9, wherein the second yoke is resilient and acts to compress the shoes against outer surface of the shaft.

11. A variable phase mechanism as claimed in claim 9, wherein means are provided between the shoes and the shaft to resiliently bias the shoes against the inner surface of the second yoke.

12. A variable phase mechanism comprising a hollow shaft, first and second members rotatable about the hollow shaft, two yokes surrounding the hollow shaft, one yoke coupling the hollow shaft for rotation with the first member and the other coupling the first member for rotation with the second member, an actuating rod slidably received in the hollow shaft, a cam surface on the actuating rod acting on the first yoke by way of a plunger passing through a generally radial bore in the hollow shaft to cause the first yoke to move radially in response to axial movement of the actuating rod so as to vary the angular position of the first member relative to the hollow shaft, the resultant rotation of the first member about the hollow shaft causing the outer surface of the hollow shaft to interact with the inner surface of the second yoke to cause the angular position of the second member to be further varied in relation to the hollow shaft.

13. A variable phase mechanism as claimed in claim 12, wherein part-cylindrical shoes are provided on the ends of the plungers acting on the inner surface of the first yoke.

14. A variable phase mechanism as claimed in claim 12, wherein part-cylindrical shoes are fitted into the surface of the shaft to act on the inner surface of the second yoke.

15. A variable phase mechanism as claimed in claim 14, wherein the second yoke is resilient and acts to compress the shoes against outer surface of the shaft.

16. A variable phase mechanism as claimed in claim 14, wherein means are provided between the shoes and the shaft to resiliently bias the shoes against the inner surface of the second yoke.

17. A variable phase mechanism comprising a hollow shaft, a member rotatable about the hollow shaft, two yokes surrounding the hollow shaft, the first yoke coupling the hollow shaft for rotation with the second yoke and the second yoke coupling the first yoke for rotation with the rotatable member, an actuating rod slidably received in the hollow shaft, a cam surface on the actuating rod acting on the first yoke by way of a plunger passing through a generally radial bore in the hollow shaft to cause the first yoke to move radially in response to axial movement of the actuating rod so as to vary the angular position of the second yoke relative to the hollow shaft, the resultant rotation of the second yoke about the hollow shaft causing the outer surface of the hollow shaft to interact with the inner surface of the second yoke to cause the angular position of the rotatable member to be further varied in relation to the hollow shaft.

18. A variable phase mechanism as claimed in claim 17, wherein part-cylindrical shoes are provided on the ends of the plungers acting on the inner surface of the first yoke.

19. A variable phase mechanism as claimed in claim 17, wherein part-cylindrical shoes are fitted into the surface of the shaft to act on the inner surface of the second yoke.

20. A variable phase mechanism as claimed in claim 19, wherein the second yoke is resilient and acts to compress the shoes against outer surface of the shaft.

21. A variable phase mechanism as claimed in claim 19, wherein means are provided between the shoes and the shaft to resiliently bias the shoes against the inner surface of the second yoke.

* * * * *